US010660375B2

(12) United States Patent
Agee et al.

(10) Patent No.: US 10,660,375 B2
(45) Date of Patent: May 26, 2020

(54) BRASSIERE HAVING REDUCED SEAMS IN THE BACK AND METHOD OF MAKING

(71) Applicant: Chico's Brands Investments, Fort Myers, FL (US)

(72) Inventors: Zofia Agee, Fort Myers, FL (US); Tiffany Harris, Fort Myers, FL (US); Balasooriya Pathabadegei Prachanna Chaminda Silva, Moratuwa (LK); Dona Seamon Patabendige Nilanthi Shiromala, Piliyandala (LK); Arulseelan Kajanthan, Dehiwala (LK)

(73) Assignee: CHICO'S BRANDS INVESTMENTS, Fort Myers, FL (US)

( * ) Notice: Subject to any disclaimer, the term of this patent is extended or adjusted under 35 U.S.C. 154(b) by 163 days.

(21) Appl. No.: 15/827,369

(22) Filed: Nov. 30, 2017

(65) Prior Publication Data

US 2018/0153226 A1 Jun. 7, 2018

Related U.S. Application Data

(60) Provisional application No. 62/428,802, filed on Dec. 1, 2016.

(51) Int. Cl.
*A41C 3/00* (2006.01)
*A41C 5/00* (2006.01)
(Continued)

(52) U.S. Cl.
CPC ..... *A41C 3/005* (2013.01); *A41C 3/00* (2013.01); *A41C 3/0014* (2013.01);
(Continued)

(58) Field of Classification Search
CPC ..... A41C 3/00; A41C 3/0014; A41C 3/005; A41C 3/0057; A41C 3/02
(Continued)

(56) References Cited

U.S. PATENT DOCUMENTS 3,392,732 A 7/1968 Holscher
2002/0022433 A1* 2/2002 Yeung ..... A41C 3/0014 450/70

(Continued)

FOREIGN PATENT DOCUMENTS

JP 2010-180509 A 8/2010
WO 2010090255 A1 8/2010

OTHER PUBLICATIONS

"Full Coverage Front Close Bra."; Soma.com, Chico's Distribution Services, LLC, Mar. 7, 2017, <<www.soma.com/store/product/vanishing+back+full+coverage+front+close+bra/570161190?color=1400&catId=cat5969283.

(Continued)

*Primary Examiner* — Gloria M Hale
(74) *Attorney, Agent, or Firm* — Grossman, Tucker, Perreault & Pfleger, PLLC

(57) ABSTRACT

A brassiere and method of making including a front portion configured to receive the breasts of the wearer and a back panel including a first lateral side affixed to the front portion and a second lateral side affixed to the front portion. The back panel includes an inner fabric layer configured to contact the wearer's skin, an outer fabric layer opposing the inner fabric layer, and reinforcing panels positioned between the inner fabric layer and the outer fabric layer. A first reinforcing panel extends from the first lateral side, a second reinforcing panel extends from a second lateral side and a third reinforcing panel extends between, but not in contact with, the first and second reinforcing panels.

20 Claims, 5 Drawing Sheets

(51) Int. Cl.
*A41C 3/02* (2006.01)
*A41C 3/12* (2006.01)

(52) U.S. Cl.
CPC ..... *A41C 3/0028* (2013.01); *A41C 3/02* (2013.01); *A41C 3/12* (2013.01); *A41C 5/00* (2013.01)

(58) Field of Classification Search
USPC ..... 450/58, 39
See application file for complete search history.

(56) References Cited

U.S. PATENT DOCUMENTS

2006/0025039 A1* 2/2006 Barbour ..... A41C 3/0057 450/1
2009/0233522 A1* 9/2009 Schlatmann ..... A41C 3/00 450/39
2010/0005569 A1* 1/2010 Sanders ..... A41C 1/003 2/400
2012/0122370 A1* 5/2012 Heath ..... A41C 3/0057 450/80
2014/0230119 A1 8/2014 Smith
2014/0235139 A1* 8/2014 Chayet ..... A41C 1/003 450/75
2015/0056890 A1* 2/2015 Black ..... A41C 3/0057 450/86
2016/0286879 A1 10/2016 Farmer et al.

OTHER PUBLICATIONS

International Search Report and Written Opinion, dated Feb. 22, 2018; issued in related International Patent Application No. PCT/US17/63910.

* cited by examiner

BRASSIERE HAVING REDUCED SEAMS IN THE BACK AND METHOD OF MAKING

CROSS REFERENCE TO RELATED APPLICATIONS

The present application claims the benefit of the filing date of U.S. Provisional Application Ser. No. 62/428,802, filed Dec. 1, 2016, the teachings of which are incorporated herein by reference.

FIELD

The present disclosure is directed to a brassiere and, particularly, to brassiere that minimizes seams in the back of the brassiere to reduce the appearance of bumps.

BACKGROUND

There are many aspects of creating a clean or smooth silhouette. One may begin with the selection of a garment exhibiting a flattering shape and fit. Further, fabric selection and how the fabrics move relative to the skin or undergarments worn underneath the garment affect the resulting silhouette. In addition, what is worn underneath the garment may also have an effect, particularly if the garment is close fitting.

An entire shapewear industry has grown to help improve the appearance of garments by reducing unsightly lumps and bumps. Some undergarments are developed to reduce their appearance under the garment. Panties and brassieres may be provided with fewer seams so as to reduce bumps in the skin due to the seams displacing body tissue. A lack of seams also helps to make the transition from the undergarment fabric to the skin less detectable. These undergarments are often referred to as "vanishing", "no-show", or "seamless".

The fabrics used to form these garments tend to exhibit relatively high elasticity and may stretch to 40% or more of the original length and up to 100% to 200% of the original length when measured via tensile testing (according to the procedure further described herein). While this makes the fabric more forgiving and able to move with the body, it does not perform well in reducing natural skin bulges under the garment. Therefore, room remains for improvement in the field of providing undergarments, and particularly brassieres, that minimize seems and reduce unsightly bulging.

SUMMARY

An aspect of the present disclosure is directed to a brassiere. The brassiere includes a front portion configured to receive the breasts of the wearer and a back panel including a first lateral side affixed to the front portion and a second lateral side affixed to the front portion. The back panel includes an inner fabric layer configured to contact the wearer's skin, an outer fabric layer opposing the inner fabric layer, and reinforcing panels positioned between the inner fabric layer and the outer fabric layer. A first reinforcing panel extends from the first lateral side, a second reinforcing panel extends from the second lateral side and a third reinforcing panel extends between, but not in contact with, the first and second reinforcing panels.

Another aspect of the present disclosure is directed to a method of forming the above described brassiere. The method includes assembling the back panel including a first lateral side and a second lateral side by providing an inner fabric layer, an outer fabric layer, and reinforcing panels positioned between the inner fabric layer and the outer fabric layer. The inner fabric layer, the outer fabric layer and the reinforcing panels are secured together to form the back panel including a first lateral side and a second lateral side and the back panel is affixed to the front portion configured to receive the breasts of a wearer.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

The present disclosure is directed to a brassiere and, particularly, to a brassiere that minimizes seams and includes a number of reinforcement panels in the back panel of the brassiere to reduce the visibility of the brassiere and reduce unsightly lumps in the back. In particular embodiments, gaps are present between the reinforcing panels. As the reinforcing panels exhibit less elongation than the fabric layers covering the reinforcing panels, the gaps between the reinforcing panels provide zones that exhibit a greater elongation. The gaps between the reinforcing zones help the brassiere move with the wearer and prevent binding of the wearer's skin while the reinforcing panels help smooth natural bulges in the wearer's skin.

Figure 1:
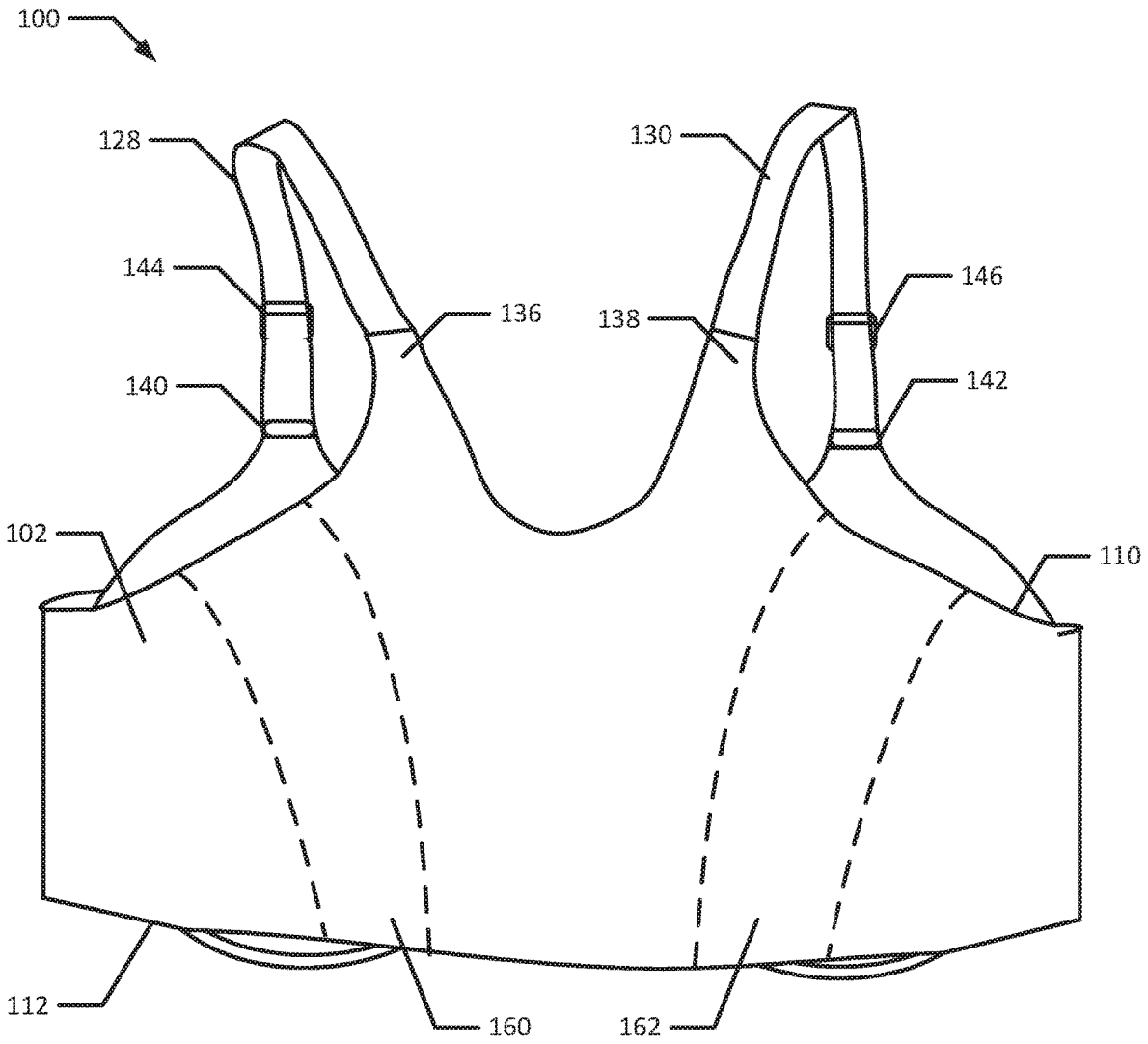
FIG. 1 is a back view of an embodiment of a brassiere.
Figure 2:
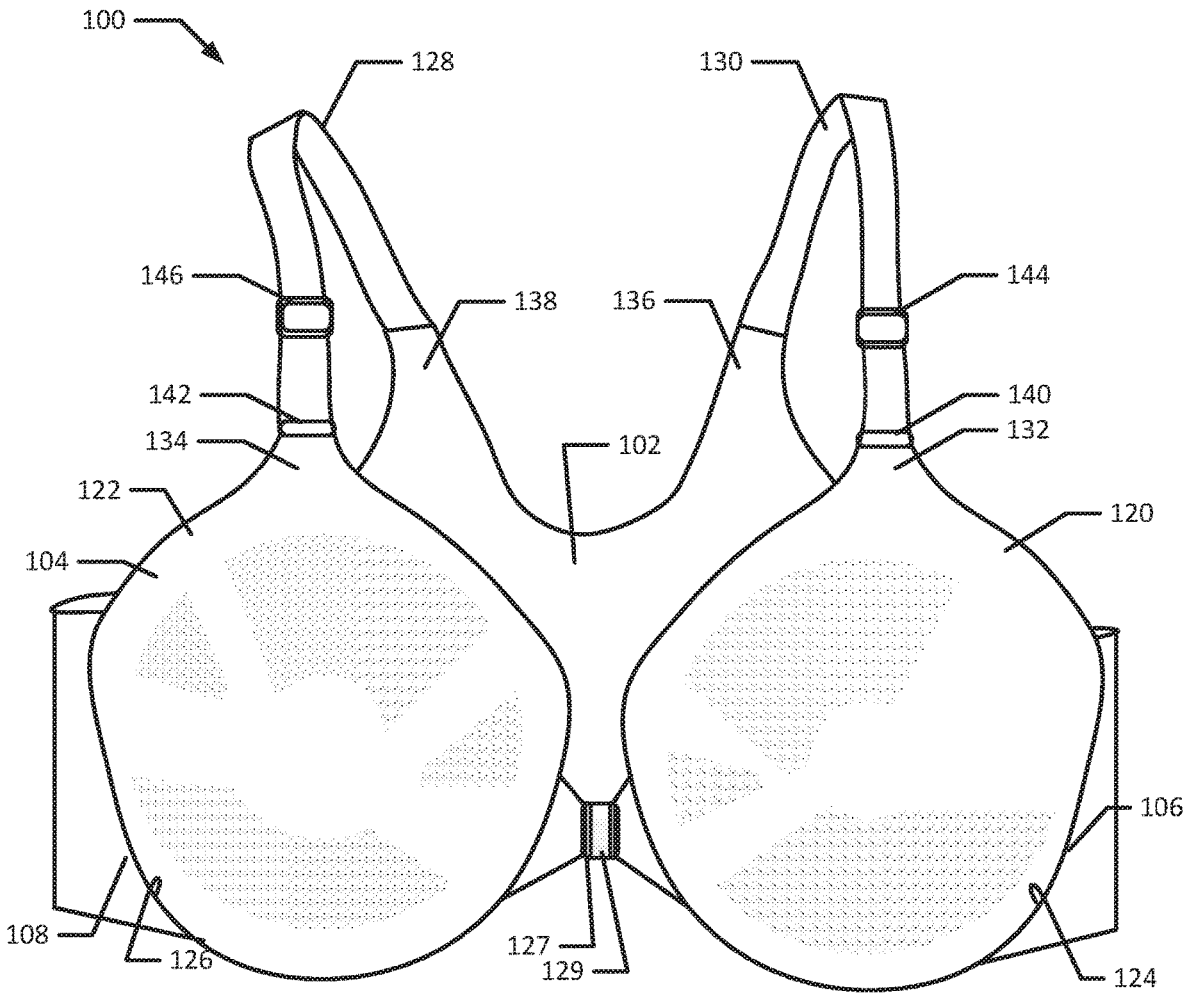
FIG. 2 is a front view of an embodiment of a brassiere.
Figure 3:
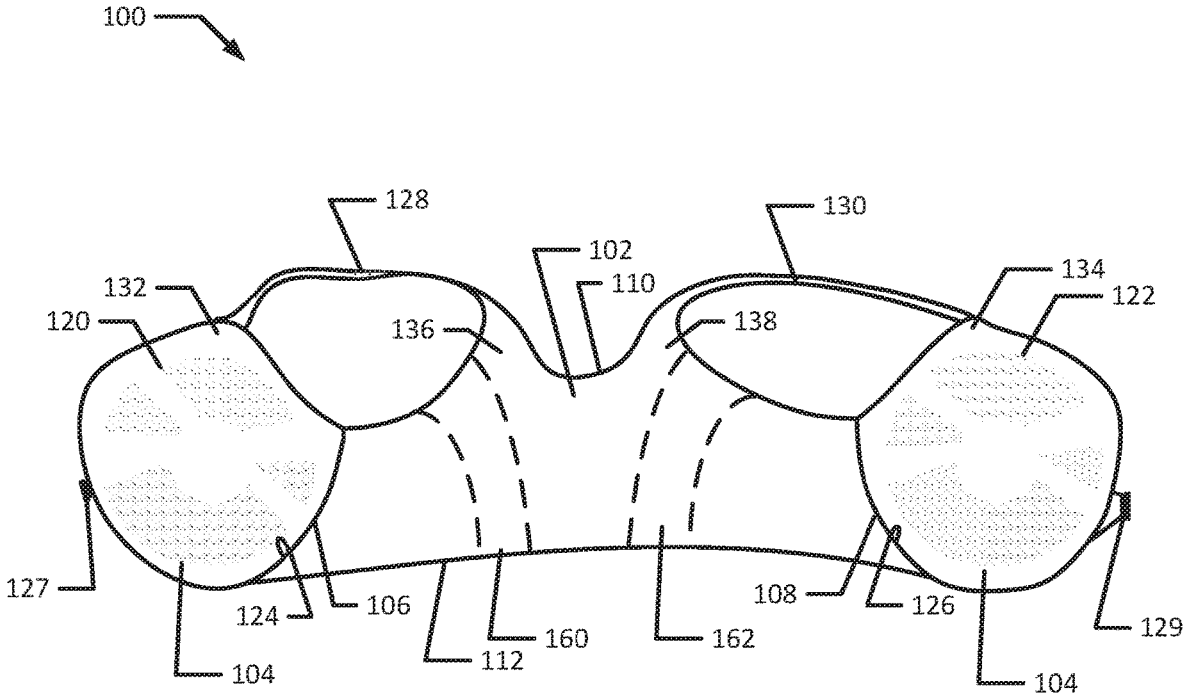
FIG. 3 is a back view of the brassiere unclasped.

An embodiment of the brassiere 100 is illustrated in FIGS. 1 through 3, which illustrates the back panel 102 of the brassiere that is worn over the wearer's back and the front portion 104 of the brassiere, which is configured to receive the breasts of the wearer. The back panel includes a first lateral side, a second lateral side, a superior edge and an inferior edge. It may be appreciated that the lateral sides 106, 108 of the back panel 102 may wrap around the wearer of the brassiere towards the anterior (front) side of the wearer's body and may even be located at the anterior side of the wearer's body depending on where the distal sides of the wearer's breasts fall.

The front portion 104 of the brassiere is illustrated as including two laterally positioned cups 120, 122; however, depending on the type of bra, the cups may be replaced by a panel, which may, or may not, be reinforced. The cups 120, 122 are preferably lined; however, they may alternatively be unlined. In addition, the cups 120, 122 may include a foam layer positioned between an inner cup fabric layer and an outer cup fabric layer. Further, the cups 120, 122 preferably include an underwire; however, an underwire may be omitted as well. It is also noted that the cups illustrated are full coverage cups, which cover over 50% of the wearer's breast tissue; however, the cups may provide less coverage as well.

The first lateral side 106 of the back panel 102 is affixed to a first side 124 of the front portion 104 and, as illustrated in FIGS. 2 and 3, is preferably affixed to a first cup 120. The second lateral side 108 of the back panel 102 is affixed to a second side 126 of the front portion and, as illustrated in FIGS. 2 and 3, is preferably affixed to a second cup 122. The first side and second side 124, 126 of the front portion laterally oppose each other.

The cups 120, 122 are preferably affixed together with a releasable clasp 127, 129 so that the brassiere may be easily removed. However, other mating mechanical fasteners may be employed in addition to, or alternatively to, the releasable clasp. For example, the releasable clasp may be substituted with, or used in combination with a zipper. Other examples of mating mechanical fasteners include hook-and-eye closures, toggles and loops, hook and loop fasteners, snaps, buckles, or tie-able ribbons or strings. The mechanical fasteners are preferably laterally positioned between the cups and, in embodiments, secured to a side of the cups 120, 122 that generally oppose the sides of the cups to which the back panel is attached. In other embodiments, a releasable clasp is positioned at the back of the garment. In such an embodiment, the back panel 102 and, specifically, the center reinforcing panel 156 may be split in half, wherein the split extends from the superior edge 110 to the inferior edge 112 of the back panel. One or more mating mechanical fasteners may be provided along the split.

In preferred embodiments, straps 128, 130 bridge the front portion of the brassiere and the back panel of the brassiere and are suspended over the shoulders of the wearer. The straps are preferably affixed to front superior tabs 132, 134 defined by the front portion, and often the cups, which in such embodiments may be tear-drop shaped. At the other end, the straps are preferably affixed to back superior tabs 136, 138 defined by said back panel 102. In alternative embodiments, the cups are not tear-drop shaped and the straps may be affixed to the superior edge of the front portion 104, or the back panel does not include superior tabs and the straps are affixed to the superior edge. In further alternative embodiments, the brassiere may be strapless, the straps may cross-over in the front or the back, or the brassiere may be worn as a halter and either end of the strap may be affixed to the front superior tabs 132, 134. The straps may be affixed such that the straps are adjustable, wherein a loop 140 is affixed each superior, front tab 132, 134. One end of each of the straps is fed through the loop and affixed to a slider 144, 146 that is configured to slide over the strap 128, 130. The other end of the strap is anchored to the back panel 102 of the brassiere. The other end of the strap may be anchored to the back panel with a seam, and preferably by a lap seam to reduce the seam bulk.

Figure 4:
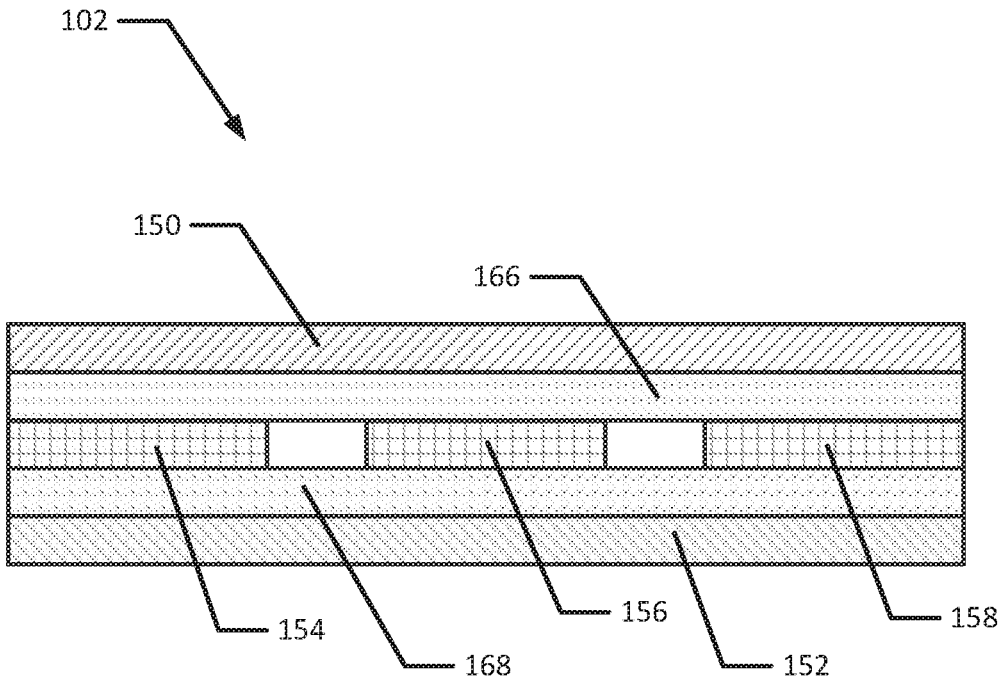
FIG. 4 is a lateral cross-sectional view of an embodiment of the back panel.

As illustrated in FIG. 4, the back panel 102 includes an inner fabric layer 150 configured to contact the wearer's skin, an outer fabric layer 152 opposing the inner fabric layer 150, and reinforcing panels 154, 156, 158 positioned between said inner fabric layer and said outer fabric layer to provide reinforcing zones. The first reinforcing panel 154 extends laterally from the first lateral side 106 of the back panel towards the center of the back panel, providing a first reinforcing zone. A second reinforcing panel 156 extends laterally from the second lateral side 108 of the back panel towards the center of the back panel, providing a second reinforcing zone. And, a third reinforcing panel 158 extends between, but not in contact with, said first and second reinforcing panels 154, 156 and is generally positioned in the center of the back panel providing a third reinforcing zone. Gaps 160, 162 are present between the reinforcing panels, where the reinforcing panels are not provided, and providing zones of greater elongation than the reinforcing zones. While the gaps are illustrated as being a void, without material present within them, during the process of securing the fabric layers together, the gaps 160, 162 between the reinforcing panels 154, 156, 158 are filled by either, or both of, the inner and outer fabric layers, which are preferably secured together in the gaps between the reinforcing zones with an adhesive.

Referring again to FIGS. 1 and 2, in preferred embodiments, the reinforcing panels extend between the superior edge 110 of the back panel and the inferior edge 112 of the back panel. More preferably, the reinforcing panels extend to the superior edge 110 of the back panel and to the inferior edge 112 of the back panel. Thus, the third reinforcing panel preferably extends into the back superior tabs 136, 138 to which the straps 128, 130 are anchored. Also, in preferred embodiments, the gaps are arc shaped. That is, the reinforcing panels are cut so as to form an arc shaped gap between them. A first arc shaped gap 160 is present between the first reinforcing panel 154 and the third reinforcing panel 158 and a second arc shaped gap 162 is present between the second reinforcing panel 156 and the third reinforcing panel 158. In addition, the arc shaped gaps extend out in opposing directions, such that the superior portions of the gaps 160, 162 are spaced closer to the lateral edges 106, 108 of the back panel than the inferior portions of the gaps 160, 162.

In embodiments, the back panel 102 is mechanically affixed to the front portion 104. For example, the back panel 102 may be affixed by stitching the lateral sides 106, 108 of the panel 102 into the edges 124, 126 of the front portion 104 and, particularly to the edges of the cups 120, 122. This may form seams at the lateral sides 106, 108 of the back panel 102. However, stitching and seams are preferably limited across the back panel 102. In preferred embodiments of the brassiere, the back panel 102 does not include any seams on the inferior edge 112 of the panel between where the first lateral side of the panel 106 is affixed to the front portion 104 and where the second lateral side of the panel 108 is affixed to the front portion 104. Further, in preferred embodiments, the back panel does not include seams on the superior edge 110 between the anchor points of the straps (such as the back superior tabs) as well as between the anchor points of the straps and the lateral sides 106, 108 where the back panel is affixed to the front portion.

The fabrics forming the inner, outer and reinforcing fabric layers preferably include nylon spandex blends including greater than 50% by weight of the total weight of the fabric nylon and spandex and up to 100% nylon and spandex by weight of the total weight of the fabric; however, it may be appreciated that natural fiber blends, including greater than 50% by weight of the total weight of the fabric is natural fibers and up to 100% by weight of the total weight of the fabric. The fabrics may be knit, woven or nonwoven.

In preferred embodiments, the inner fabric layer includes fabrics made from nylon spandex fiber blends including in the range of 15 to 25% by weight spandex and in the range of 75 to 85% by weight nylon, wherein the % weight is of the total weight of the fabric. In embodiments, the fabric may consist of nylon and spandex, wherein nylon and spandex are selected from the above ranges to equal 100% by weight. In other embodiments, additional fiber materials, such as cotton, polyester or rayon may be selected to form the fabrics. The fabric forming the inner layer is preferably knit and, more preferably, warp knit and, more preferably, stretch tricot fabric. The fabric preferably exhibits a basis weight in the range of 150 grams per square meter to 200 grams per square meter, and more preferably in the range of 160 grams per square meter to 180 grams per square meter. The fabric also preferably exhibits an elongation of greater than 75% of the initial length of the fabric, such as in the range of 75% to 210% of the initial length of the fabric.

Elongation may be greater in the machine direction (i.e., length) of the fabric than the transverse direction (i.e. width) of the fabric, and in preferred embodiments elongation may be 150% to 200% greater in the machine direction than in the transverse direction of the fabric.

Elongation values provided herein (including the elongation values described in the background) are measured via tensile testing, preferably using an INSTRON testing system or equivalent testing device with a 25 kg load cell and jaw clamps for fabric testing three inches wide. The test is conducted on three, ten inch by three inch strips of fabric cut in the longitudinal width direction. The strips are marked with a line 2.5 inches from the center in both directions so that a five inch mark is positioned in the center of the fabric. The fabric is conditioned in a standard atmosphere of 21+/1° C. and relative humidity of 65%+/−2% for a minimum of four hours prior to testing. Each specimen is positioned in the jaws so that the five inch mark (gauge length) is between the clamps, which are then tightened. The load is zero'd and the load is then applied at a rate of 20 inches per minute crosshead speed, a chart speed of 10 inches per minute may be used. Each specimen is elongated until a load of 7.5 pounds is achieved and then the fabric is returned to zero extension. The fabric is extended again in a second testing cycle at the same speed and the load is recorded at 20%, 40%, and 60% extension. Additionally the total elongation at 7.5 pounds is recorded. The load is then returned to zero and the immediate recovery is calculated. Each of the three specimens is tested individually and the average result is reported. The load is reported at the various extensions recorded in the second testing cycle. Elongation is the % extension at 7.5 pounds in the second testing cycle, unless indicated otherwise. Further, recovery is measured by determining the difference between the elongated length and recovered length and dividing this value by the difference between the elongated length and the original length. This value is multiplied by 100.

Further, in such preferred embodiments, the outer fabric layer includes nylon spandex blends including in the range of 5 to 15% by weight spandex and in the range of 85 to 95% by weight nylon, wherein the % weight is of the total weight of the fabric. In embodiments, the fabric may consist of nylon and spandex, wherein nylon and spandex are selected from the above ranges to equal 100% by weight. In other embodiments, additional fiber materials, such as cotton, polyester or rayon may be selected to form the fabrics. The fabrics forming the outer layer are preferably knit fabrics, but may also be lace, which may be either knit or woven. The fabric preferably exhibits a basis weight in the range of 130 grams per square meter to 180 grams per square meter, and more preferably from 150 grams per square meter to 170 grams per square meter. Further, the fabric preferably exhibits an elongation in the range of 30 to 220% of the initial length of the fabric. Elongation may be greater in the machine direction (i.e., length) of the fabric than the transverse direction (i.e. width) of the fabric, and in preferred embodiments elongation may be 300 to 400% greater in the machine direction than in the transverse direction of the fabric.

It may be appreciated that in alternative embodiments the inner fabric layer and the outer fabric layer are formed from the same material. In such embodiments, the outer fabric layer and inner fabric layer may be formed from a single piece of fabric. The fabric may be doubled over with the reinforcing layers entrained within.

Also, in preferred embodiments, the reinforcing fabrics include nylon spandex blends including the range of 25 to 40% by weight spandex, including all values and ranges therein, and in the range of 60 to 75% by weight nylon, including all values and ranges therein, wherein the % weight is of the total weight of the fabric. More preferably, nylon is present in the range of 65 to 70% by weight and spandex is present in the range of 30 to 35% by weight. Again, when the fabric consists of nylon and spandex, nylon and spandex are selected form the above ranges to equal 100% by weight. In other embodiments, additional fiber materials, such as cotton, polyester or rayon may be selected to form the fabrics. The fabrics forming the reinforcing layer are preferably knit fabrics. The areal weight of the fabric is preferably in the range of 2 to 5 ounces per square yard, including all values and ranges therein. The fabric preferably exhibits an elongation that is less than the elongation of the outer fabric layer, the inner fabric layer or both. In preferred embodiments the elongation is at least 25% less than the elongation of the inner fabric layer, including all values and ranges of 25% less than the elongation of the inner fabric layer to 75% less than the elongation of the inner fabric.

Accordingly, in embodiments, the inner fabric layer, the outer fabric layer, or both the inner fabric layer and the outer fabric layer, exhibit a greater tensile elongation than said reinforcing layer. In such a manner, gap 160 between the first reinforcing panel 154 and the third reinforcing panel 158 and gap 162 between the second reinforcing panel 156 and the third reinforcing panel 158 exhibit a greater tensile elongation than regions of said back panel where said first, second and third reinforcing panels 154, 156, 158 are present. Thus, gaps 160, 162 provide zones that are relatively more extensible than the reinforcing zones provided by the first, second and third reinforcing panels 154, 156, 158.

It is also noted that the inner fabric layer, reinforcing layer, and outer fabric layer are bonded together. The layers may be bonded together mechanically or with an adhesive, or by a combination of mechanical and adhesive bonding techniques. In preferred embodiments adhesive is disposed between the inner fabric and outer fabric layers. The adhesive may be provided as a liquid or as a solid, such as in sheets, "glue dots" (which are understood to be discrete adhesive elements that assume a number of geometries including circular, square, diamond, rectangular, etc.), tape, or powder form. The adhesive may be activated by pressure, heat or both, where it may form mechanical or chemical bonds with itself, the fabrics or both itself and the fabrics. The adhesives may include a number of polymeric materials, such as polyurethane and polyamide. In preferred embodiments, polyurethane is applied as a tape along the superior edges 110 and inferior edge 112 of the back panel 102 and polyamide glue dots are utilized across the field of the back panel 102 between the superior and inferior edges 110, 112.

In embodiments, the inner fabric and outer fabric layers are bonded together around the reinforcing panels. However, preferably, a first layer of adhesive 166 is provided between the inner fabric layer and the reinforcing layer and a second layer of adhesive 168 is provided between the outer fabric layer and the reinforcing layer.

Figure 5:
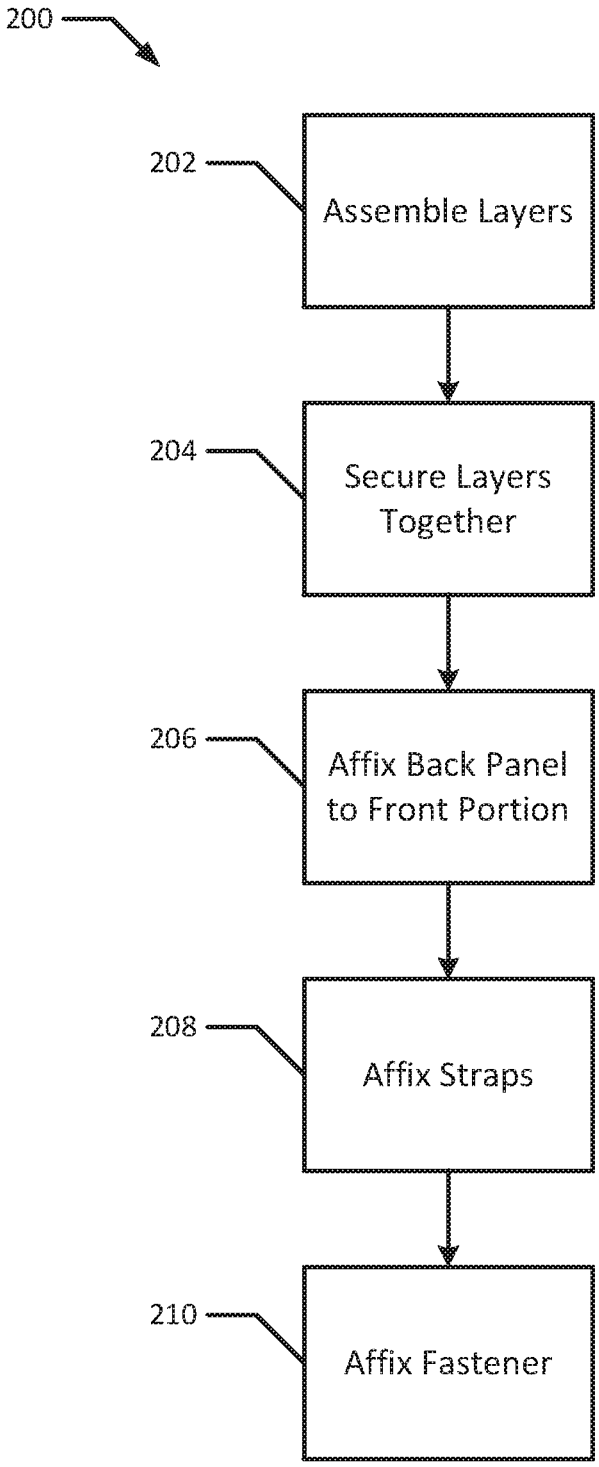
FIG. 5 is a flow diagram of an embodiment of a method of forming a brassiere described herein.

A general method of forming a brassiere is illustrated in FIG. 5. The method 200 includes assembling a back panel 202 by providing an inner fabric layer, an outer fabric layer and reinforcing panels positioned between said inner fabric layer and said outer fabric layer. Each of the fabric layers may be cut out of a single ply of fabric. Multiple plies of fabric may be cut at the same time. Once cut, the fabric layers are stacked together and the adhesive is applied while stacking or after stacking. As noted above, the adhesive may be applied by providing an adhesive sheet, spreading an adhesive powder or a liquid over the fabric. It is noted, in particular, that the reinforcing panels may, at this time, be lined up relative to the inner fabric layer and the outer fabric layer, so that the first reinforcing panel extends from the first lateral side, the second reinforcing panel extends from a second lateral side and a third reinforcing panel extends between, but not in contact with, the first and second reinforcing panels.

The fabric layers may then be secured together 204. If an adhesive is used, the fabric layers are secured by activating the adhesive using, for example, pressure, heat or both pressure and heat applied to the adhesive. In embodiments, the fabric layers may be passed through a press or calender rolls to apply pressure and heat. In some embodiments, either the inner fabric layer or the outer fabric layer is not cut and the other layers are assembled on the uncut inner or outer fabric layer. The uncut layer may be used to carry the assembly of the layers to additional processing stations, such as through the press or rollers used to activate the adhesive. After processing of the back panels is complete and before affixing to the front portion, the uncut layer may then be cut.

Once the back panel is formed, the back panel may be affixed to the front portion 206. In embodiments, where the front panel includes cups, the lateral sides of the back panel may be attached to the cups while the cups are being assembled. The straps, if present, are secured to the front portion and the back panel 208. The straps may be secured before or after affixing the back panel to the front portion. If superior tabs are present in the front portion and back panel, the straps are affixed to the superior tabs. A mechanical fastener, such a releasable clasp, is also affixed to the cups 210. It may be appreciated that while steps 206, 208, and 210 are illustrated as occurring after the back panel is affixed to the front portion, the steps may occur in a different order. For example, the mechanical fastener may be affixed to the front portion before the back panel is affixed to the front portion. Or the straps may be affixed to the front portion and back panel before the front portion and back panel are assembled.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A brassiere for the breasts of a wearer, comprising:

a front portion configured to receive the breasts of the wearer;

a back panel including a first lateral side affixed to said front portion and a second lateral side affixed to said front portion; and wherein the back panel includes an inner fabric layer configured to contact the wearer's skin, an outer fabric layer opposing said inner fabric layer, and reinforcing panels positioned between said inner fabric layer and said outer fabric layer, wherein a first reinforcing panel extends from said first lateral side, a second reinforcing panel extends from the second lateral side and a third reinforcing panel extends between, but not in contact with, said first and second reinforcing panels.

2. The brassiere of claim 1, wherein said inner fabric layer and said outer fabric layer exhibit a greater tensile elongation than said reinforcing layer, wherein a first region of said back panel between said first reinforcing panel and said third reinforcing panel and a second region of said back panel between said second reinforcing panel and said third reinforcing panel exhibit a greater tensile elongation than regions of said back panel where said first, second and third reinforcing panels are present.

3. The brassiere of claim 1, wherein said reinforcing panels extend between a superior edge of said back panel and an inferior edge of said back panel.

4. The brassiere of claim 1, wherein a first arc shaped gap is present between said first reinforcing panel and said third reinforcing panel and a second arc shaped gap is between said second reinforcing panel and said third reinforcing panel between the inner fabric layer and the outer fabric layer, wherein said first and second arc shaped gaps are present between said inner fabric layer and said outer fabric layer.

5. The brassiere of claim 4, wherein said first arc shaped gap and said second arc shaped gap extend from an inferior edge of said back panel to a superior edge of said back panel.

6. The brassiere of claim 4, wherein said first arc shaped gap and said second arc shaped gap arc in opposing directions.

7. The brassiere of claim 1, wherein said back panel has no seams on the inferior edge of the back panel between the location where the first lateral side is affixed to said front portion and where the second lateral side is affixed to said front portion.

8. The brassiere of claim 1, wherein said front portion includes two laterally positioned cups.

9. The brassiere of claim 8, wherein a releasable clasp is provided between said two cups.

10. The brassiere of claim 1, further comprising straps bridging said front portion and said back panel, wherein said straps are affixed to front superior tabs defined by said front portion and back superior tabs defined by said back panel.

11. The brassiere of claim 10, wherein said third reinforcing panel extends into said back superior tabs.

12. The brassiere of claim 10, wherein said back panel includes no seams on the superior edge of the back panel between the back superior tabs.

13. The brassiere of claim 10, wherein said back panel includes no seams between each back superior tab and the lateral sides where the back panel is affixed to the front portion.

14. The brassiere of claim 1, wherein said inner fabric layer and said outer fabric layer are bonded together with an adhesive between said layers.

15. The brassiere of claim 14, wherein said adhesive is provided between said inner fabric layer and said reinforcing layer and between said outer fabric layer and said reinforcing layer.

16. The brassiere of claim 1, wherein said inner fabric layer and said outer fabric layer are formed from a single piece of fabric doubled over.

17. A method of forming a brassiere back panel for attachment to a brassiere front portion which brassiere front portion receives a wearer's breasts, comprising:

assembling a back panel including a first lateral side and a second lateral side by providing an inner fabric layer, an outer fabric layer and reinforcing panels positioned between said inner fabric layer and said outer fabric layer, wherein a first reinforcing panels extends from said first lateral side, a second reinforcing panel extends from said second lateral side and a third reinforcing panel extends between, but not in contact with, said first and second reinforcing panel, securing said inner fabric layer, said outer fabric layer and said reinforcing panels together to form said back panel including a first lateral side and a second lateral side; and affixing said back panel to said brassiere front portion that is configured to receive the wearer's breasts.

18. The method of claim 17, further comprising securing said inner fabric layer, said outer fabric layer and said reinforcing panels together with adhesive disposed between said fabric layers and said reinforcing panels.

19. The method of claim 17, further comprising securing straps to said front portion and said back panel, wherein said straps are affixed to front superior tabs defined by said front portion and to back superior tabs defined by said back panel.

20. The method of claim 17, wherein said front portion includes two laterally positioned cups and said method further comprises affixing a releasable clasp to said front portion between said cups.

* * * * *